US005458039A

United States Patent [19]

Ashby

[11] Patent Number: 5,458,039

[45] Date of Patent: Oct. 17, 1995

[54] HEEL ACTIVATED DRUM PEDAL

[76] Inventor: Larry J. Ashby, 1167 Turner St., Apt. 312, Clearwater, Fla. 34616

[21] Appl. No.: 268,963

[22] Filed: Jun. 30, 1994

[51] Int. Cl.[6] ..... G10D 13/02

[52] U.S. Cl. ..... 84/422.1

[58] Field of Search ..... 84/422.1, 422.2, 84/422.3

[56] References Cited

U.S. PATENT DOCUMENTS

| | | | |
|---|---|---|---|
| 3,988,957 | 11/1976 | Escamilla | 84/422.1 |
| 4,567,808 | 2/1986 | Smith | 84/422.1 |
| 4,691,612 | 9/1987 | Smith | 84/422.1 |
| 5,090,289 | 2/1992 | Holcomb | 84/422.1 |

*Primary Examiner*—Michael L. Gellner
*Assistant Examiner*—Patrick J. Stanzione

[57] ABSTRACT

A heel activated drum pedal for actuating a drum mallet with the heel of a foot for striking a drum comprising an elongated base plate having a front and a rear end; a drum mallet; a crankshaft coupled to the drum mallet for allowing rotation of the drum mallet; a first coupling mechanism for rotatably coupling the crankshaft to the front end of the base plate; a limiting mechanism for limiting the rotation of the drum mallet about a defined upper and lower limit; an elongated foot pedal having a front and a rear end; a second coupling mechanism for rotatably coupling the front end of the foot pedal to the front end of the base plate; a spring mechanism coupled between the foot pedal and the base plate, the spring mechanism having a contracted orientation for allowing the rear end of the foot pedal to be moved towards the rear end of the base plate and an expanded orientation for allowing the rear end of the foot pedal to be positioned offset from the rear end of the base plate; and an actuating mechanism coupled between the crankshaft and the foot pedal for allowing the drum mallet to move in one direction toward the upper limit of the limiting mechanism, whereby enabling the drum mallet to move toward and strike a drum positioned adjacent thereto, and allowing the drum mallet to move in another direction toward the lower limit of the limiting mechanism, whereby enabling the drum mallet to be moved away from the drum.

4 Claims, 4 Drawing Sheets

HEEL ACTIVATED DRUM PEDAL

BACKGROUND OF THE INVENTION

1. Field of the Invention

The present invention relates to a heel activated drum pedal and more particularly pertains to actuating a drum mallet with the heel of a foot for striking a drum with a heel activated drum pedal.

2. Description of the Prior Art

The use of drum pedals is known in the prior art. More specifically, drum pedals heretofore devised and utilized for the purpose of actuating a drum mallet for striking a drum are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,567,808 to Smith discloses a foot operated bass drum pedal. U.S. Pat. No. 4,747,333 to Hoshino discloses remotely controlled foot pedal operated beaters for drums. U.S. Pat. No. 4,819,536 to Lombardi discloses a drum pedal movement responsive device to produce electrical signal. U.S. Pat. No. 4,890,532 to Carlson discloses a foot activated musical drum pedal device. U.S. Pat. No. 4,945,803 to Norwood discloses a double beat bass drum pedal assembly.

While these devices fulfill their respective, particular objective and requirements, the aforementioned patents do not describe a heel activated drum pedal that is actuated with the heel of a foot in one orientation and actuated with the ball of a foot in another orientation.

In this respect, the heel activated drum pedal according to the present invention substantially departs from the conventional concepts and designs of the prior art, and in doing so provides an apparatus primarily developed for the purpose of actuating a drum mallet with the heel of a foot for striking a drum.

Therefore, it can be appreciated that there exists a continuing need for new and improved heel activated drum pedal which can be used for actuating a drum mallet with the heel of a foot for striking a drum. In this regard, the present invention substantially fulfills this need.

SUMMARY OF THE INVENTION

In the view of the foregoing disadvantages inherent in the known types of drum pedals now present in the prior art, the present invention provides an improved heel activated drum pedal. As such, the general purpose of the present invention, which will be described subsequently in greater detail, is to provide a new and improved heel activated drum pedal and method which has all the advantages of the prior art and none of the disadvantages.

To attain this, the present invention essentially comprises, in combination, an elongated and essentially planar base plate having a top surface, bottom surface, and opposed front and rear edges with opposed side edges extended therebetween, a pair of spaced and axially aligned front eyelets, each eyelet extended upwards from the top surface and positioned adjacent to a side edge, a pair of spaced and axially aligned rear eyelets, each rear eyelet extended upwards from the top surface and positioned adjacent to a side and rear edge, and a plurality of adjustment holes disposed and aligned on both side edges between the front eyelets and rear eyelets. A pair of spaced and axially aligned support eyelets is included with each support eyelet coupled to the top surface of the base plate and extended upwards above the front eyelets and positioned adjacent to the front edge of the base plate with one support eyelet having a groove formed thereon with one end of the groove terminated at a lower limit and the other end of the groove extended above the lower limit and terminated in an upper limit. A drum mallet is included. The drum mallet has a head made of soft material, a collar downwardly offset from the head, and an elongated arm coupled therebetween. A crankshaft is extended through and coupled to the collar of the drum mallet and rotatably disposed through the support eyelets with each end of the crankshaft having a shaft eyelet coupled thereto. The crankshaft further includes a limit pin extended outwardly therefrom and disposed within the groove of the support eyelet for limiting the axial rotation of the crankshaft between the upper limit and the lower limit of the groove. A pair of spaced eye screws is included with each eye screw coupled to the base plate between a front eyelet and a support eyelet. A pair of springs is included with each spring having one end coupled to a shaft eyelet on the crankshaft and the other end extended downwards and coupled with an eye screw, each spring adapted for urging the limit pin of the crankshaft towards the lower limit of the groove. A cross arm is included and extended between the pair of support eyelets and offset above the base plate. An elongated and planar actuator plate is included and positioned above the base plate in contact therewith with the actuator plate having a front end, a rear end, and an intermediate portion therebetween, the front end disposed adjacent to the support eyelets, the intermediate portion slidably disposed between the front eyelets of the base plate, and the rear end extended peripherally outwards from the side edges of the base plate and positioned between the front eyelets and the adjustment holes of the base plate. A flexible mallet strap is included and has a first end coupled to the collar of the mallet and a second end extended around the cross arm and coupled to the front end of the actuator plate with an actuator transfer pin. An elongated and essentially planar foot pedal is included and has a front end and a rear end, opposed front and rear edges extended around the ends, and opposed side edges extended between the front and rear edges, a front tongue formed on the front edge and extended outwards therefrom, a rear tongue formed on the rear edge and extended outwards therefrom, the front tongue having an elongated cavity disposed therethrough, an elongated alignment aperature disposed thereon and allowing access to the cavity, a pair of axially aligned support pins disposed within the cavity with portions extended outwards from each end thereof with each pin having a pin handle formed thereon and extended through alignment aperature for allowing the outward extent of each support pin to be adjusted, and a spring extended between the pair of support pins for urging the support pins away from each other, with the support pins disposed within the front eyelets of the base plate to align and pivotally couple the foot pedal with the base plate. A pair of upwardly extended and generally U-shaped guiding brackets are included with each guiding bracket having an inner leg, an outer leg, a cross leg therebetween, and two spaced free ends remote from the cross leg, each inner leg coupled to the side edge of the base plate between the adjustment holes and rear eyelets thereof, each guiding bracket further having a guide pin coupled between the free ends of the legs creating a guiding channel adapted to hold an actuator strap therein. A pair of opposed and axially aligned bottom pivot pins are included with each bottom pivot pin coupled to an edge of the base plate between a guiding bracket and the rear end of the actuator plate. A pair of opposed and axially aligned top pivot pins is included with each top pivot pin coupled to a side edge of the foot pedal near the rear edge thereof. A pair of opposed actuator straps is included with each strap having a first end and a second end with the first end coupled to the rear end of the actuator plate and the second end extended around a bottom pivot pin and through a guiding channel and coupled to a top pivot pin. When the rear end of the foot pedal is depressed, the actuator straps pull the actuator plate and the second end of the mallet strap toward the rear edge of the base plate, the crankshaft rotates such that the limit pin moves towards the upper limit of the groove, and the arm of the drum mallet rotates about the crankshaft, thus allowing the head of the drum mallet to move toward and strike a drum positioned adjacent thereto. When the rear edge of the pedal is released, the springs cause the crankshaft to rotate such that the limit pin moves towards the lower limit of the groove, and the arm of the drum mallet rotates about the crankshaft, thus allowing the head of the drum mallet to move away from the drum.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heel activated drum pedal which has all the advantages of the prior art drum pedals and none of the disadvantages.

It is another object of the present invention to provide a new and improved heel activated drum pedal which may be easily and efficiently manufactured and marketed.

It is a further object of the present invention to provide a new and improved heel activated drum pedal which is of durable and reliable construction.

An even further object of the present invention is to provide a new and improved heel activated drum pedal which is susceptible of a low cost of manufacture with regard to both materials and labor, and which accordingly is then susceptible of low prices of sale to the consuming public, thereby making such a heel activated drum pedal economically available to the buying public.

Still yet another object of the present invention is to provide a new and improved heel activated drum pedal which provides in the apparatuses and methods of the prior art some of the advantages thereof, while simultaneously overcoming some of the disadvantages normally associated therewith.

Even still another object of the present invention is to provide a new and improved heel activated drum pedal for actuating a drum mallet with the heel of a foot for striking a drum.

Lastly, it is an object of the present invention to provide a new and improved heel activated drum pedal comprising an elongated base plate having a front end and a rear end; a drum mallet; a crankshaft coupled to the drum mallet for allowing rotation of the drum mallet when the craftshaft is axially rotated; first coupling means for rotatably coupling the crankshaft to the front end of the base plate; limiting means for limiting the rotation of the drum mallet about the crankshaft between a defined upper limit and a defined lower limit; an elongated foot pedal having a front end and a rear end; second coupling means for rotatably coupling the front end of the foot pedal to the front end of the base plate; spring means coupled between the foot pedal and the base plate, the spring means having a contracted orientation for allowing the rear end of the foot pedal to be moved towards the rear end of the base plate when the foot pedal is depressed and an expanded orientation for allowing the rear end of the foot pedal to be positioned offset from the rear end of the base plate when the foot pedal is released; and actuating means coupled between the crankshaft and the foot pedal for allowing the drum mallet to move in one direction toward the upper limit of the limiting means when the rear end of the foot pedal is depressed, whereby enabling the drum mallet to move toward and strike a drum positioned adjacent thereto, and allowing the drum mallet to move in another direction toward the lower limit of the limiting means when the rear end of the foot pedal is released, whereby enabling the drum mallet to be moved away from the drum.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
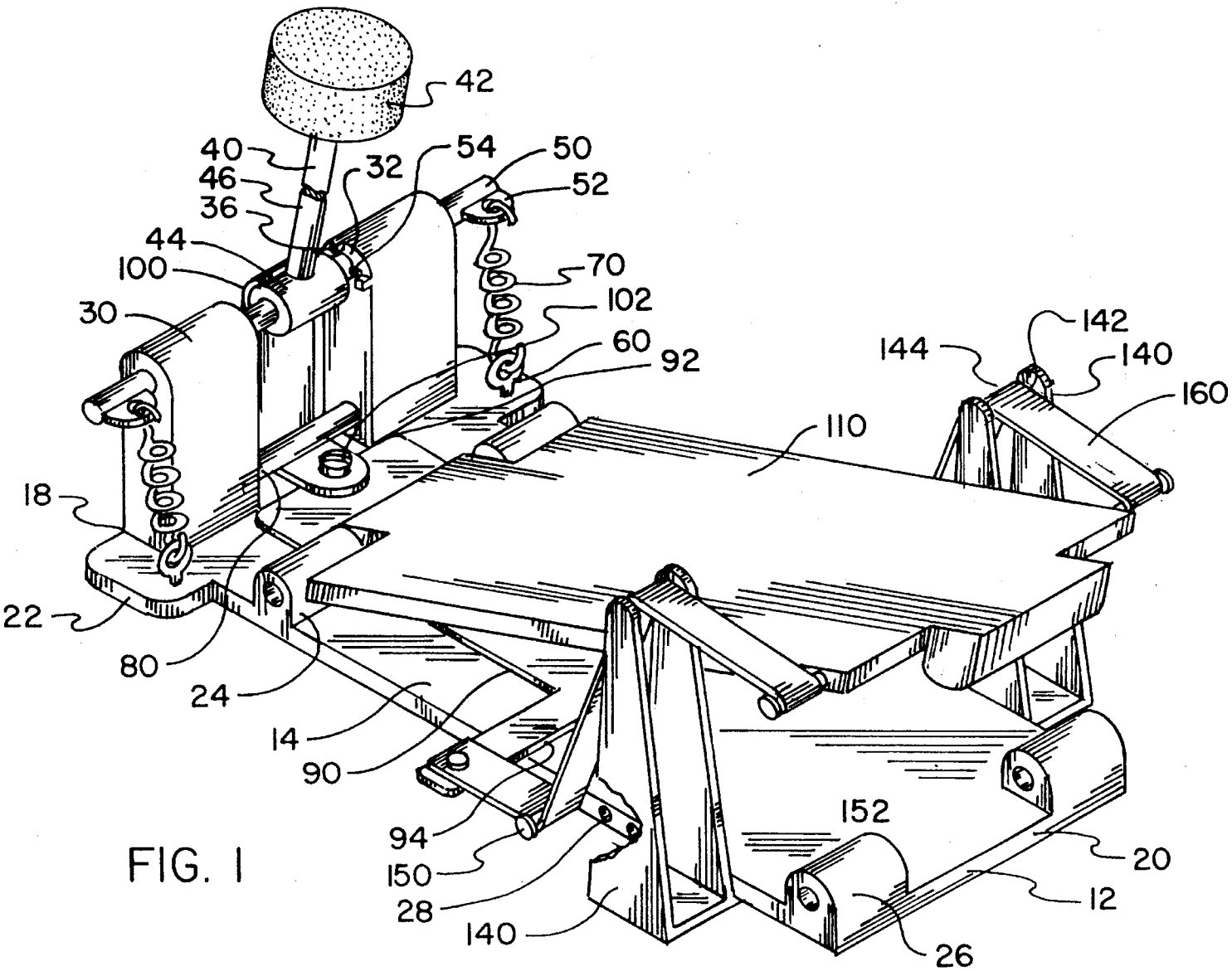
FIG. 1 is a perspective view of the preferred embodiment of the heel activated drum pedal constructed in accordance with the principles of the present invention.
Figure 3:
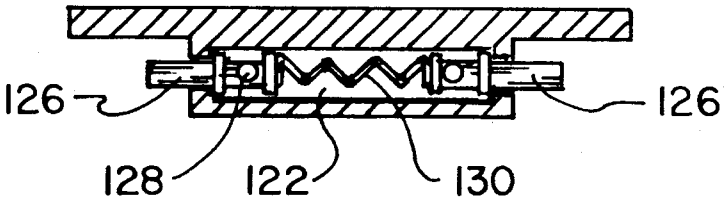
FIG. 3 is a cross sectional view of the front tongue of the foot pedal taken along the line 3—3 of FIG. 2.
Figure 2:
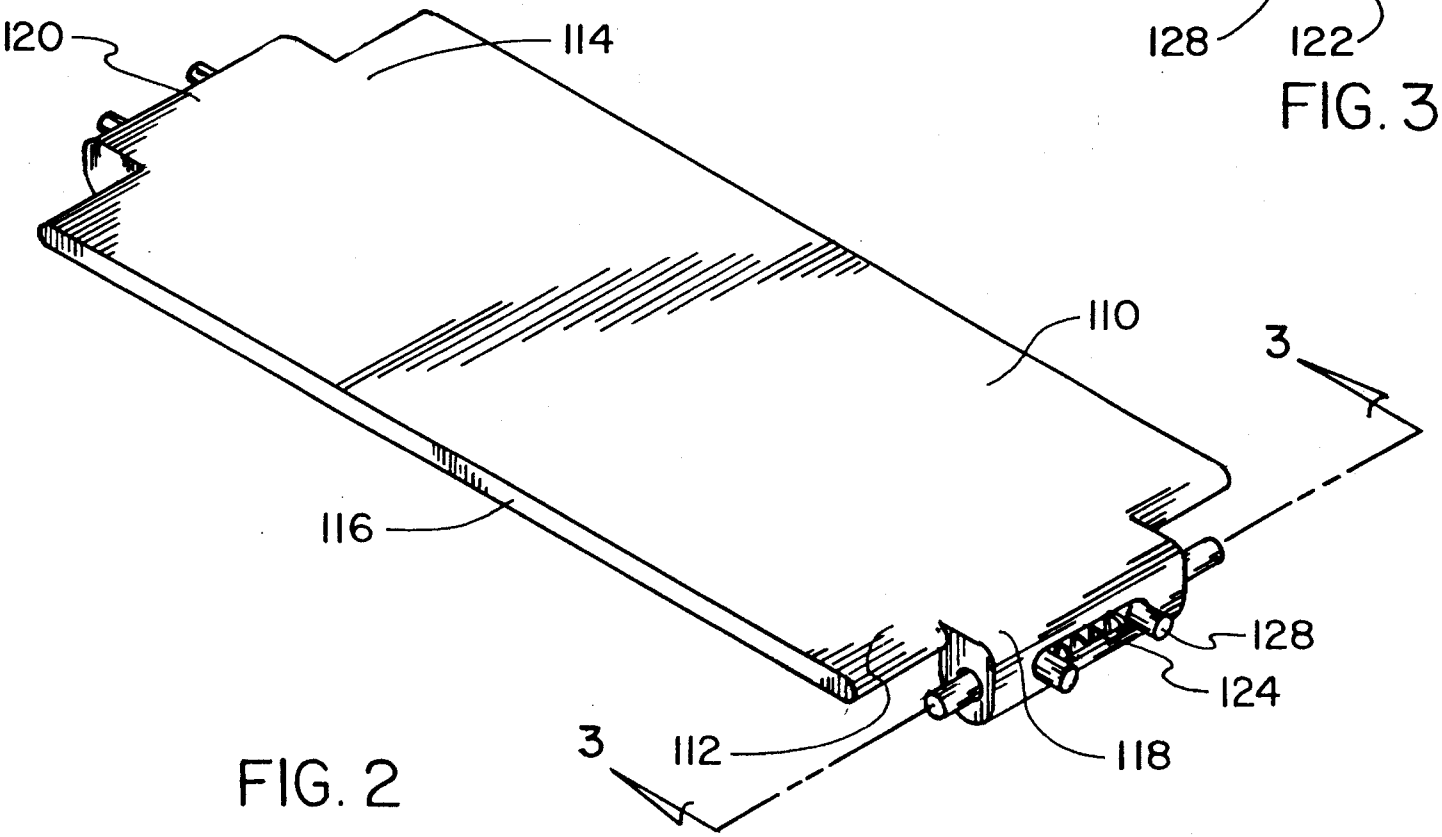
FIG. 2 is a perspective view of the foot pedal of the present invention.
Figure 4:
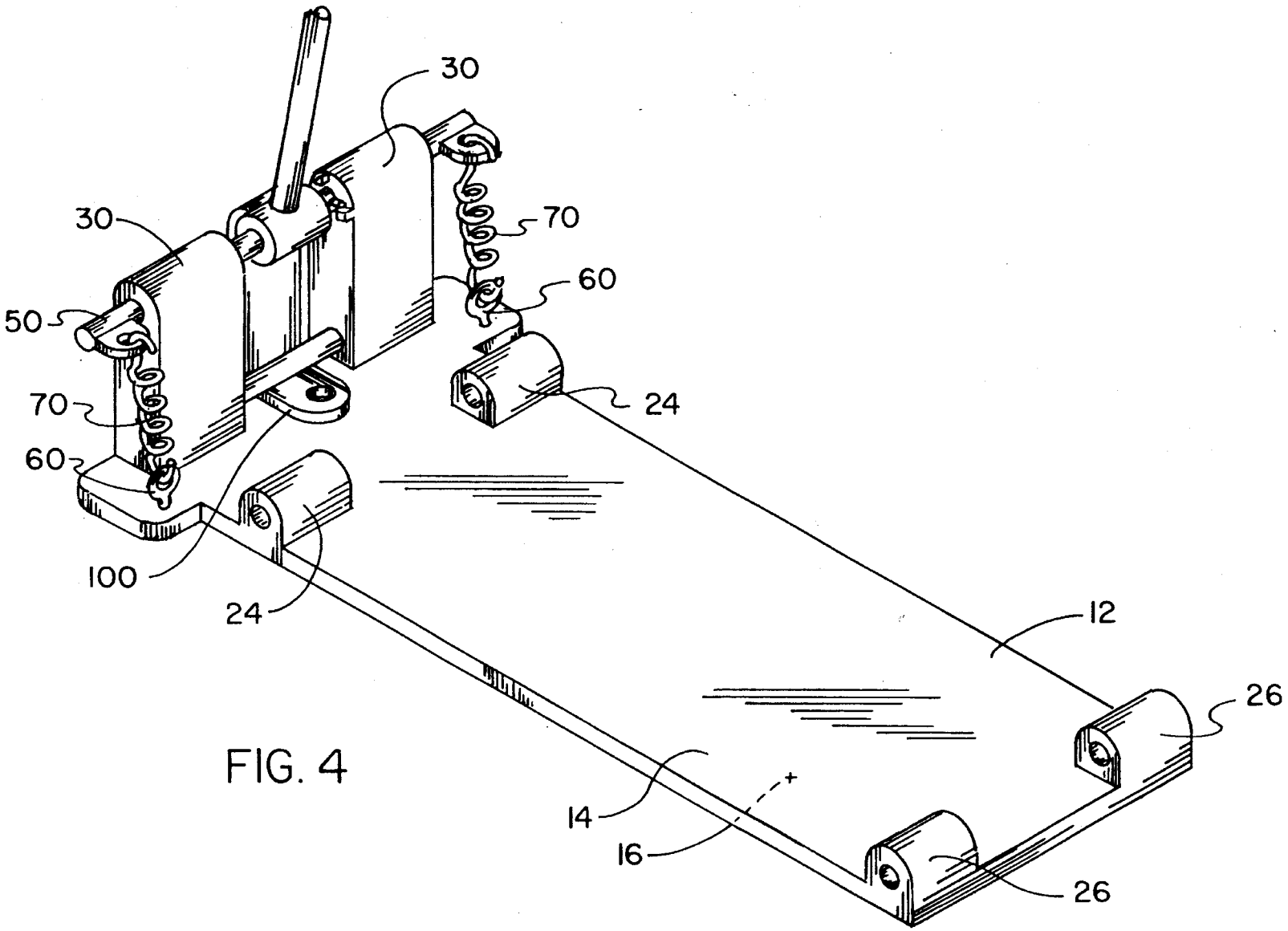
FIG. 4 is a perspective view of the base plate and the coupling between the base plate and drum mallet.

With reference now to the drawings, and in particular, to FIG. 1 thereof, the preferred embodiment of the new and improved heel activated drum pedal embodying the principles and concepts of the present invention and generally designated by the reference number 10 will be described.

Specifically, the present invention includes 13 major components. The major components are the base plate, support eyelets, drum mallet, crankshaft, eye screws, springs, cross arm, actuator plate, mallet strap, foot pedal, guiding brackets, pivot pins, and actuator straps. These components are interrelated to provide the intended function.

More specifically, it will be noted in the various Figures that the first major component is the base plate 12. The base plate is elongated and essentially planar in structure. The base plate has a top surface 14 and a bottom surface 16. The base plate also has opposed front and rear edges 18, 20 with opposed side edges 22 extended therebetween. The base plate also includes a pair of spaced and axially aligned front eyelets 24. Each front eyelet is extended upwards from the top surface and positioned adjacent to a side edge. The holes through the eyelets are aligned about a common axis of symmetry. The base plate also includes a pair of spaced and axially aligned rear eyelets 26. Each rear eyelet is extended upwards from the top surface and positioned adjacent to a side and rear edge. The holes through the rear eyelets are aligned about a common axis of symmetry. Furthermore, the base plate includes a plurality of adjustment holes 28. The adjustment holes are aligned on both side edges between the front eyelets and the rear eyelets. The holes are adapted to adjust the travel of a separate foot pedal to be attached to the base plate.

The second major component is a pair of spaced and axially aligned support eyelets 30. Each support eyelet is coupled to the top surface 14 of the base plate. Each support eyelet is extended upwards from the top surface of the base plate and above the front eyelets 24. Furthermore, the eyelets are each positioned adjacent to the front edge 18 of the base plate. One of the support eyelets has a groove 32 formed thereon. The groove is positioned on the upper portion of the support eyelet and faces inwards towards the other eyelet. One end of the groove is terminated at a lower limit 34. The other end of the groove is extended upwards above the lower limit and terminated in an upper limit 36. The limits are adapted to restrict the travel of an object placed within the groove.

The third major component is the drum mallet 40. The drum mallet has a head 42 made of soft material. The head is adapted to be used against a base drum. The drum mallet also has a collar 44 downwardly offset from the head. An elongated arm 46 is coupled between the head and the collar.

The fourth major component is the crankshaft 50. The crankshaft is extended through and coupled to the collar 44 of the drum mallet. The crankshaft is rotatably disposed through the support eyelets 30 such that the collar is positioned therebetween. Each end of the crankshaft has a shaft eyelet 52 coupled thereto. The crankshaft also has a limit pin 54 coupled thereto. The limit pin is positioned within the groove 32 of the support eyelet near the collar. The limit pin is used for limiting the axial rotation of the crankshaft between the upper limit 36 and the lower limit 34 of the groove. This limiting action insures that the head of the mallet may be angularly rotated about the collar within a pre-determined measure.

The fifth major component is a pair of eyescrews 60. Each eyescrew is coupled to the base plate 12 between a front eyelet 24 and a support eyelet 26. The eyescrews are adapted to hold one end of an urging member extended between the eyescrew and the shaft eyelet.

The sixth major component is a pair of springs 70. Each spring has one end coupled to a shaft eyelet 52 on the crankshaft. The other end of the spring is extended downward and coupled with an eyescrew 60. Each spring is adapted for urging the limit pin 54 of the crankshaft towards the lower limit 34 of the groove.

The seventh major component is the cross arm 80. The cross arm is extended between the pair of support eyelets 30. It is positioned at a location offset from the base plate 12. The cross arm is used as a guiding mechanism for guiding forces directed towards the crankshaft for rotation thereof.

The eighth major component is the actuator plate 90. The actuator plate is elongated and planar in structure. It is positioned upon the top surface 14 of the base plate. The actuator plate has a front end 92, a rear end 94, and an intermediate portion therebetween. The front end is disposed adjacent to the support eyelets 30 with the edge of the front end aligned with the cross arm 80. The intermediate portion is extended from the front end and slidably disposed between the front eyelets 24 of the base plate. The rear end of the actuator plate is extended peripherally outwards to extend over the side edges 22 of the base plate. The rear end is positioned between the front eyelets 24 and the alignment holes 28 of the base plate.

The ninth major component is the mallet strap 100. The mallet strap is flexible and has a first end coupled to the collar 44 of the mallet. The mallet strap also has a second end extended around the cross arm and coupled to the front end 92 of the actuator plate with an actuator transfer pin 102. This coupling places the mallet strap in an essentially L-shaped configuration for transferring pivoting forces to and from the crankshaft 50.

The tenth major component is the foot pedal 110. The foot pedal is elongated and essentially planar in structure. The foot pedal also has front and rear edges extended around the ends, and opposed side edges 116 extended between the front and rear edges. A front tongue 118 is formed on the front edge and extended outwards therefrom. A rear tongue 120 is formed on the rear edge and extended outwards therefrom. The front tongue has an elongated cavity 122 disposed therethrough. An elongated alignment aperture 124 is disposed on the front tongue and allows access to the cavity. A pair of axially aligned support pins 126 are disposed within the cavity. Portions of the support pins are extended outwards from each end of the cavity. Each pin has a pin handle 128 formed thereon and extended through the alignment aperture. The pin handle allows the outward extent of each support pin from the cavity to be adjusted. A spring 130 is extended between the pair of support pins. The spring is used for urging the support pins away from each other. The outward extent of the support pins are disposed within the front eyelets 24 of the base plate such that the front tongue is positioned between the front eyelets. The foot pedal is thus aligned with the base plate and pivotally coupled thereto.

The eleventh major component is a pair of guiding brackets 140. Each guiding bracket is upwardly extended and generally U-shaped. Each guiding bracket has an inner leg, an outer leg, and a cross leg therebetween. Each bracket has two spaced free ends positioned remote from the cross leg. Each inner leg of the bracket is coupled to a side edge 22 of the base plate between the adjustment holes 28 and the rear eyelets 26. Each guiding bracket further includes a guide pin 142 coupled between the free ends of the legs. The guide pin in combination with the upper portion of the U-shaped bracket creates a guiding channel 144 adapted to hold an actuator strap therein.

The twelfth major component is the pivot pins. The present invention includes a pair of opposed and axially aligned bottom pivot pins 150. Each bottom pivot pin is coupled to an edge of the base plate between a guiding bracket and the rear edge of the actuator plate. The present invention also includes a pair of opposed and axially aligned top pivot pins 152. Each top pivot pin is coupled to a side edge of the foot pedal near the rear edge thereof. The pivot pins in combination are adapted to transfer forces from the pedal to the actuator plate.

The thirteenth major component is the actuator straps 160. The present invention includes a pair of opposed actuator straps. Each actuator strap has a first end and a second end. The first end is coupled to the rear end 94 of the actuator plate. The second end of the actuator strap is extended around a bottom pivot pin 150 and through a guiding channel 144 and then coupled to a top pivot pin 152. The actuator straps in combination are used to transfer forces from the pedal to the actuator plate for rotating the drum mallet.

When the rear end 114 of the foot pedal is depressed, the actuator straps 160 pull the actuator plate 90 and the mallet strap 100 towards the rear edge 20 of the base plate. The crankshaft 50 then rotates such that the limit pin 54 moves towards the upper limit 36 of the groove. The arm 46 of the drum mallet then rotates about the crankshaft. This action allows the head 42 of the drum mallet to move toward and strike a drum positioned adjacent thereto. When the rear edge of the pedal is released, the springs 70 cause the crankshaft to rotate. The limit pin on the crankshaft then moves towards the lower limit 34 of the groove. The arm of the drum mallet then rotates about the crankshaft. This action allows the head of the drum mallet to move away from the drum.

Figure 5:
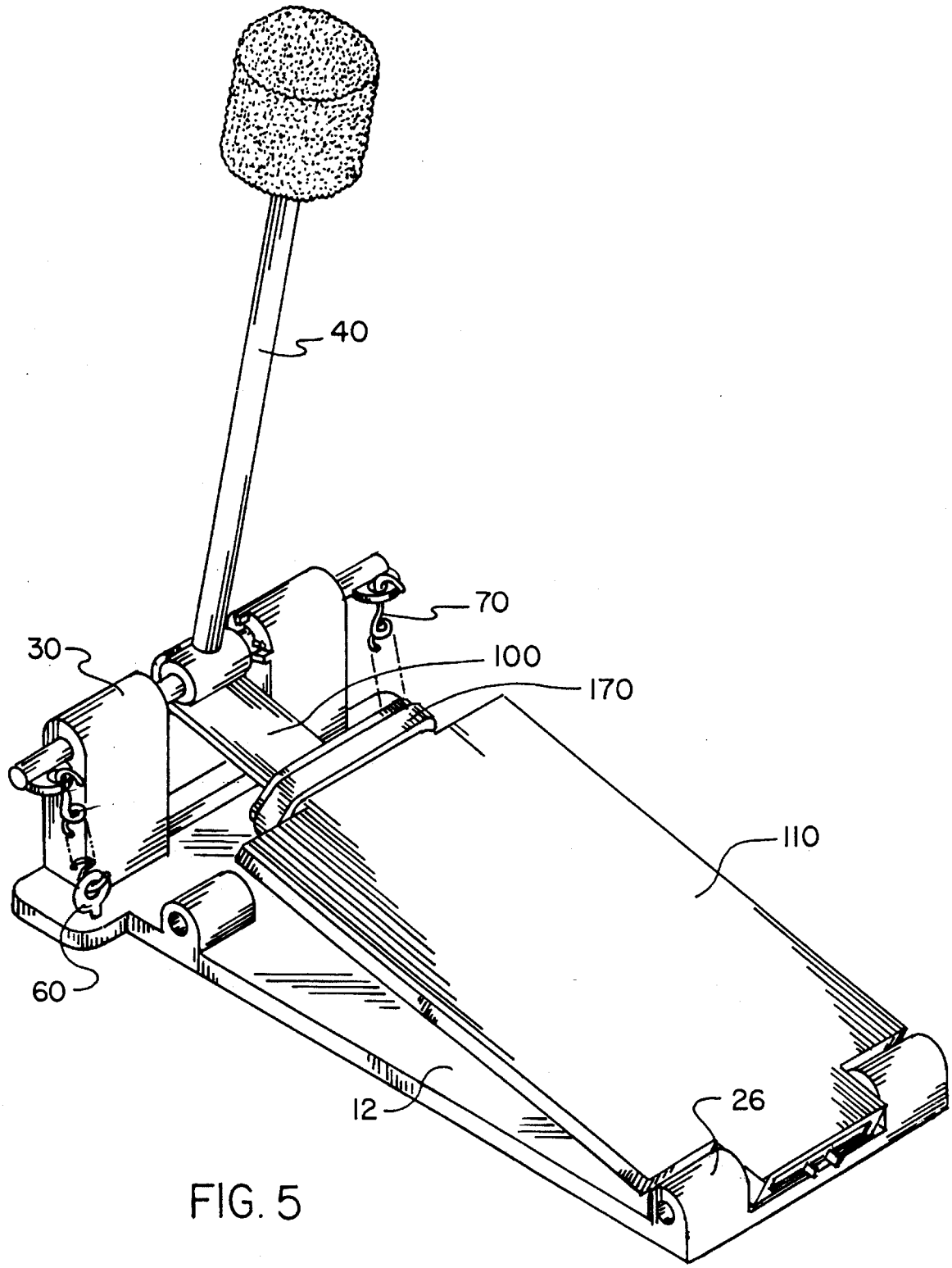
FIG. 5 is a perspective view of the present invention with the foot pedal rotated and coupled to the drum mallet such that the drum mallet is actuated with the ball of a foot.

A second embodiment of the present invention is shown in FIG. 5 and includes substantially all of the components of the present invention further including reversible coupling means 170. The reversible coupling means are adapted to be removably coupled between the base plate 12, the foot pedal 110, and the mallet straps 100. The reversible coupling means enable the foot pedal to be pivotally connected to the rear end of the base plate for allowing a drum mallet 40 to move in one direction toward the upper limit 36 of the limiting means when the front end 112 of the foot pedal is depressed. This action enables the drum mallet to move toward and strike a drum positioned adjacent thereto. The reverse coupling means also enable the drum mallet to move in another direction toward the lower limit 34 of the limiting means when the front end of the foot pedal is released. This action enables the drum mallet to be moved away from the drum.

The present invention is specifically designed to satisfy the unique operational needs of drummers. Contrary to the operational needs of other musicians, like a trumpet player, for example, the drummer requires a great deal of room, a keen sense for the pulse of the music, and above all, stamina. A drummer requires stamina because of the labor intensive operation of the various parts of the drum set. A high quality pair of oak drum sticks can weigh as much as eight ounces and require considerable upper body strength. The high hat is operated with the left foot and requires substantial calf muscles to lift and close this instrument. The bass drum is played with the right foot and requires an enormous amount of leg strength to generate the low, earthy pulse of cannon fire that is synonymous with this instrument. Bass drum beats frequently require rapid succession pulses for particular styles of music. This increases the fatigue of using the foot pedal. Prior art embodiments of bass drum foot pedal mechanisms are similar to a vehicle's accelerator and are actuated with the ball of the foot. The present invention differs from the prior art embodiments because it has been designed to be actuated with the heel of a foot, whereby enabling a drummer increase the speed at which the bass drum can be played and to help ease the strain of doing so. To accomplish this, the present invention consists of a foot pedal that is higher at the heel than at the ball of the foot, and an actuator that is similar in concept to conventional foot pedals. The height of the heel portion of the present invention is adjustable to accommodate any drummer's preference. Another unique feature of the present invention is that the pedal can be removed and reversed for operating in the customary fashion while the frame and actuator remain in the same location. The present invention is effective at alleviating fatigue of a drummer through the act of lifting the heel of a drummer's foot off the floor. This position is more natural than lifting the ball of the foot as is required by the prior art devices.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A heel activated drum pedal for actuating a drum mallet with the heel of a foot for striking a drum comprising, in combination:

an elongated and essentially planar base plate having a top surface, bottom surface, and opposed front and rear edges with opposed side edges extended therebetween, a pair of spaced and axially aligned front eyelets, each eyelet extended upwards from the top surface and positioned adjacent to a side edge, a pair of spaced and axially aligned rear eyelets, each rear eyelet extended upwards from the top surface and positioned adjacent to a side and rear edge, and a plurality of adjustment holes disposed and aligned on both side edges between the front eyelets and rear eyelets;

a pair of spaced and axially aligned support eyelets, each support eyelet extended upwards above the front eyelets and positioned adjacent to the front edge of the base plate with one support eyelet having a groove formed thereon with one end of the groove terminated at a lower limit and the other end of the groove extended above the lower limit and terminated in an upper limit;

a drum mallet having a head made of soft material, a collar downwardly offset from the head, and an elongated arm coupled therebetween;

a crankshaft extended through and coupled to the collar of the drum mallet and rotatably disposed through the support eyelets, each end of the crankshaft having a shaft eyelet coupled thereto, the crankshaft further having a limit pin extended outwardly therefrom and disposed within the groove of the support eyelet for limiting the axial rotation of the crankshaft between the upper limit and the lower limit of the groove;

a pair of spaced eye screws, each eye screw coupled to the base plate between a front eyelet and a support eyelet;

a pair of springs, each spring having one end coupled to a shaft eyelet on the crankshaft and the other end extended downwards and coupled with an eye screw, each spring adapted for urging the limit pin of the crankshaft towards the lower limit of the groove;

a cross arm extended between the pair of support eyelets and offset above the base plate;

an elongated and planar actuator plate positioned above the base plate in contact therewith, the actuator plate having a front end, a rear end, and an intermediate portion therebetween, the front end disposed adjacent to the support eyelets, the intermediate portion slidably disposed between the front eyelets of the base plate, and the rear end extended peripherally outwards from the side edges of the base plate and positioned between the front eyelets and the adjustment holes of the base plate;

a flexible mallet strap having a first end coupled to the collar of the mallet and a second end extended around the cross arm and coupled to the front end of the actuator plate with an actuator transfer pin;

an elongated and essentially planar foot pedal having a front end and a rear end, opposed front and rear edges extended around the ends, and opposed side edges extended between the front and rear edges, a front tongue formed on the front edge and extended outwards therefrom, a rear tongue formed on the rear edge and extended outwards therefrom, the front tongue having an elongated cavity disposed therethrough, an elongated alignment aperture disposed thereon and allowing access to the cavity, a pair of axially aligned support pins disposed within the cavity with portions extended outwards from each end thereof, each pin having a pin handle formed thereon and extended through alignment aperture for allowing the outward extent of each support pin to be adjusted, and a spring extended between the pair of support pins for urging the support pins away from each other, with the support pins disposed within the front eyelets of the base plate to align and pivotally couple the foot pedal with the base plate;

a pair of upwardly extended and generally U-shaped guiding brackets, each guiding bracket having an inner leg, an outer leg, a cross leg therebetween, and two spaced free ends remote from the cross leg, each inner leg coupled to the side edge of the base plate between the adjustment holes and rear eyelets thereof, each guiding bracket further having a guide pin coupled between the free ends of the legs creating a guiding channel adapted to hold an actuator strap therein;

a pair of opposed and axially aligned bottom pivot pins, each bottom pivot pin coupled to an edge of the base plate between a guiding bracket and the rear end of the actuator plate;

a pair of opposed and axially aligned top pivot pins, each top pivot pin coupled to a side edge of the foot pedal near the rear edge thereof; and a pair of opposed actuator straps, each strap having a first end and a second end with the first end coupled to the rear end of the actuator plate and the second end extended around a bottom pivot pin and through a guiding channel and coupled to a top pivot pin;

whereby when the rear end of the foot pedal is depressed, the actuator straps pull the actuator plate and the second end of the mallet strap toward the rear edge of the base plate, the crankshaft rotates such that the limit pin moves towards the upper limit of the groove, and the arm of the drum mallet rotates about the crankshaft, thus allowing the head of the drum mallet to move toward and strike a drum positioned adjacent thereto, and when the rear edge of the pedal is released, the springs cause the crankshaft to rotate such that the limit pin moves towards the lower limit of the groove, and the arm of the drum mallet rotates about the crankshaft, thus allowing the head of the drum mallet to move away from the drum.

2. A heel activated drum pedal for actuating a drum mallet with the heel of a foot for striking a drum comprising:

an elongated base plate having a front end and a rear end;

a drum mallet;

a crankshaft coupled to the drum mallet for allowing rotation of the drum mallet when the crankshaft is axially rotated;

first coupling means for rotatably coupling the crankshaft to the front end of the base plate;

limiting means for limiting the rotation of the drum mallet about the crankshaft between a defined upper limit and a defined lower limit;

an elongated foot pedal having a front end and a rear end;

second coupling means for rotatably coupling the front end of the foot pedal to the front end of the base plate;

spring means coupled between the foot pedal and the base plate, the spring means having a contracted orientation for allowing the rear end of the foot pedal to be moved towards the rear end of the base plate when the foot pedal is depressed and an expanded orientation for allowing the rear end of the foot pedal to be positioned offset from the rear end of the base plate when the foot pedal is released; and actuating means coupled between the crankshaft and the foot pedal for allowing the drum mallet to move in one direction toward the upper limit of the limiting means when the rear end of the foot pedal is depressed, whereby enabling the drum mallet to move toward and strike a drum positioned adjacent thereto, and allowing the drum mallet to move in another direction toward the lower limit of the limiting means when the rear end of the foot pedal is released, whereby enabling the drum mallet to be moved away from the drum.

3. The device as set forth in claim 2 and further including reversible coupling means adapted to be removably coupled between the base plate, the foot pedal, and the actuating means for enabling the foot pedal to be pivotally connected to the rear end of the base plate for allowing the drum mallet to move in one direction toward the upper limit of the limiting means when the front end of the foot pedal is depressed, whereby enabling the drum mallet to move toward and strike a drum positioned adjacent thereto, and allowing the drum mallet to move in another direction toward the lower limit of the limiting means when the front end of the foot pedal is released, whereby enabling the drum mallet to be moved away from the drum.

4. The device as set forth in claim 2 and further including adjustable means coupled between the base plate and foot pedal for allowing the adjustment of the offset between the rear end of the foot pedal and rear end of the base plate when the spring means are in the expanded orientation.

* * * * *